US007419159B2

(12) United States Patent
Dodge

(10) Patent No.: US 7,419,159 B2
(45) Date of Patent: Sep. 2, 2008

(54) METHOD FOR PLAYING VIDEO GAMES WITH IMPROVED PLAYER INTEREST

(75) Inventor: Clifford B. Dodge, Billings, MT (US)

(73) Assignee: Gametech International, Reno, NV (US)

( * ) Notice: Subject to any disclaimer, the term of this patent is extended or adjusted under 35 U.S.C. 154(b) by 274 days.

(21) Appl. No.: 11/205,664

(22) Filed: Aug. 17, 2005

(65) Prior Publication Data

US 2007/0060236 A1 Mar. 15, 2007

(51) Int. Cl.
*A63F 1/00* (2006.01)

(52) U.S. Cl. ..... 273/292; 463/13

(58) Field of Classification Search ..... 273/292, 273/274, 309; 463/13, 12
See application file for complete search history.

(56) References Cited

U.S. PATENT DOCUMENTS 6,164,652 A * 12/2000 Lauretta et al. ..... 273/292
6,227,969 B1 * 5/2001 Yoseloff ..... 463/13

* cited by examiner

*Primary Examiner*—Benjamin H Layno
(74) *Attorney, Agent, or Firm*—Dillon & Yudell LLP

(57) ABSTRACT

An improved video draw poker game is disclosed that deals a player an initial five card draw poker hand plus an additional match hand of cards. After the player has held and replaced cards to obtain a final hand of cards from which draw poker winnings are determined in a conventional manner, the final hand of cards is compared to the match hand of cards to determine additional winnings based on face value and suit matches between cards in the draw hand and in the match hand. The match concept is also disclosed as used with a game played on a video slot machine.

8 Claims, 13 Drawing Sheets

PAY TABLE

| | BET 1 | BET 2 | BET 3 | BET 4 | BET 5 | BET 6 | BET 7 |
|---|---|---|---|---|---|---|---|
| Royal Flush | 750 | 1500 | 2250 | 3000 | 3750 | 4500 | 5250 |
| Straight Flush | 100 | 200 | 300 | 400 | 500 | 600 | 700 |
| 4 Of A Kind | 25 | 50 | 75 | 100 | 125 | 150 | 175 |
| Full House | 7 | 14 | 21 | 28 | 35 | 42 | 49 |
| Flush | 5 | 10 | 15 | 20 | 25 | 30 | 35 |
| Straight | 4 | 8 | 12 | 16 | 20 | 24 | 28 |
| 3 Of A Kind | 3 | 6 | 9 | 12 | 15 | 18 | 21 |
| Two Pair | 2 | 4 | 6 | 8 | 10 | 12 | 14 |
| Jacks Or Better | 1 | 2 | 3 | 4 | 5 | 6 | 7 |

| | BET 8 | BET 9 | BET10 |
|---|---|---|---|
| Royal Flush | 6000 | 6000 | 6000 |
| Straight Flush | 800 | 900 | 1000 |
| 4 Of A Kind | 200 | 225 | 250 |
| Full House | 56 | 63 | 70 |
| Flush | 40 | 45 | 50 |
| Straight | 32 | 36 | 40 |
| 3 Of A Kind | 24 | 27 | 30 |
| Two Pair | 16 | 18 | 20 |
| Jacks Or Better | 8 | 9 | 10 |

*Figure 3*

METHOD FOR PLAYING VIDEO GAMES WITH IMPROVED PLAYER INTEREST

FIELD OF THE INVENTION

The invention relates to electronic video games that provide winnings to a player based on predetermined combinations of game play icons obtained by the player during game play, and additional winnings are provided to the player based on matches between the game play icons obtained by the player during game play and other game play icons dealt to the player at the beginning of game play.

BACKGROUND OF THE INVENTION

Electronic wagering games, such as video poker and video slot machines, are more successful, wherever they are played, when players are provided with a sense of participation and control, the opportunity to make decisions, reasonable odds of winning, and what the players perceive is an improved chance to beat the odds that are normally in favor of a casino.

Poker, in its many variations, is well known and is played using a standard deck of playing cards, and no standard poker hand contains more than five cards. In poker, various combinations of five cards from a standard fifty-two card deck have significance based on both the numerical or face value of the cards and their suits. The basic object of poker is for a player to achieve a five card hand having a higher poker rank than the hands held by the player's opponents. Even when wild cards are used, they only substitute for cards in the defined combinations and do not create new or broader combinations of winning poker hands, although they improve the odds of having a winning hand.

Poker is played in a number of variations including draw poker and stud poker. Probably the most common and popular poker variation is draw poker in which the player has the opportunity to substitute one or more of the cards they are initially dealt in an effort to improve the value of their hand.

The introduction of computerized, video poker games permits players to see the representation of dealt card hands on a video screen, and the players usually play against a standard payout table retained in a computer memory. For one example, conventional video draw poker is a single player game in which a player does not play against a dealer or other players, but rather tries to achieve the highest possible ranking poker hand. A payout schedule is used to determine the amount of winnings awarded to the player for achieving specified winning combinations of cards. After an initial deal of five cards, the player is allowed to discard unwanted cards and draw replacement cards. The number of winning card combinations possible in a five card draw poker game means that, even at the lower payout value levels, a player has a relatively low probability of having a winning hand, even though lower ranked winning hands of cards are the ones which occur most frequently.

The conventional poker hand rankings that are used in video draw poker, from the highest to lowest, are: royal flush, straight flush, four of a kind, full house, flush, straight, three of a kind, two pair and a pair of jacks or better. Any hand having less than a pair of jacks or better is a losing hand. There is a wide difference in the winnings between a royal flush and a pair of jacks or better.

Over time gaming casino patrons become bored with standard versions of video poker games, as well as other video games found on slot machines, and the casinos are continually looking for new variations of video poker and other video games to continually create renewed interest and attract more players to play the games.

It would therefore be advantageous to have new video poker games and games on video slot machines which are similar to conventional games in their playing strategy but which provide for greater player interaction with the game and which would appear to provide greater opportunities for winning. Such new games would stimulate renewed interest of experienced players, and the interest of casual players, who will both find the new games exciting.

SUMMARY OF THE INVENTION

The present invention combines the most desirable elements of conventional video poker games and other games played on video slot machines with a novel improvement that gives a player more sense of participation and control, the opportunity to make decisions, reasonable odds of winning, and what the players perceive is a chance to beat odds that are normally in favor of a casino.

With respect to the game of draw poker the novel improvement is achieved by dealing a player an initial five card draw poker hand plus an additional five card hand called a match hand. A player selects cards to be held and non-held cards are replaced in a conventional fashion to get a final five card draw poker hand that determines what winnings the player has achieved. Additional winnings are achieved in the following manner. The individual cards in the final five card draw poker hand are compared to the five cards of the five card match hand for face value and suit match. That is, the first card in the final five card draw poker hand is compared to the first card in the match hand, the second card in the final five card draw poker hand is compared to the second card in the match hand, and so on to the fifth card in the final five card draw poker hand being compared to the fifth card in the five card match hand. Additional winnings are achieved for each match in the suit between the two hands. When in each comparison the face value of the cards is the same a higher amount of winnings are achieved. When in each comparison both the face value and the suit are the same an even higher amount of winnings are achieved. This novel game play is called "Match Poker" in the preferred embodiment of the invention.

In an alternative embodiment of the invention two initial five card draw poker hands are dealt plus the additional five card match hand. The conventional draw poker winnings and the novel match winnings previously described are accomplished for each of the two five card draw poker hands but the one five card match hand is used for both draw poker hands.

In another embodiment of the invention, with respect to games played on machines such as video slot machines, a player places their bet(s) and actuates the spin of the video slot reels. One or more conventional rows of slot symbols are displayed, plus another row of match slot symbols to implement the matching concept of the present invention. The conventional rows of slot symbols are analyzed for winnings in a known manner. Each of the conventional rows of slot symbols are then compared to the row of match slot symbols to determine any additional game winnings.

DESCRIPTION OF THE DRAWINGS

The invention will be better understood upon reading the following Detailed Description in conjunction with the drawing in which:

FIG. 3 shows a pay table used in determining winnings when playing the conventional draw poker part of Match Poker;

DETAILED DESCRIPTION

Figure 1:
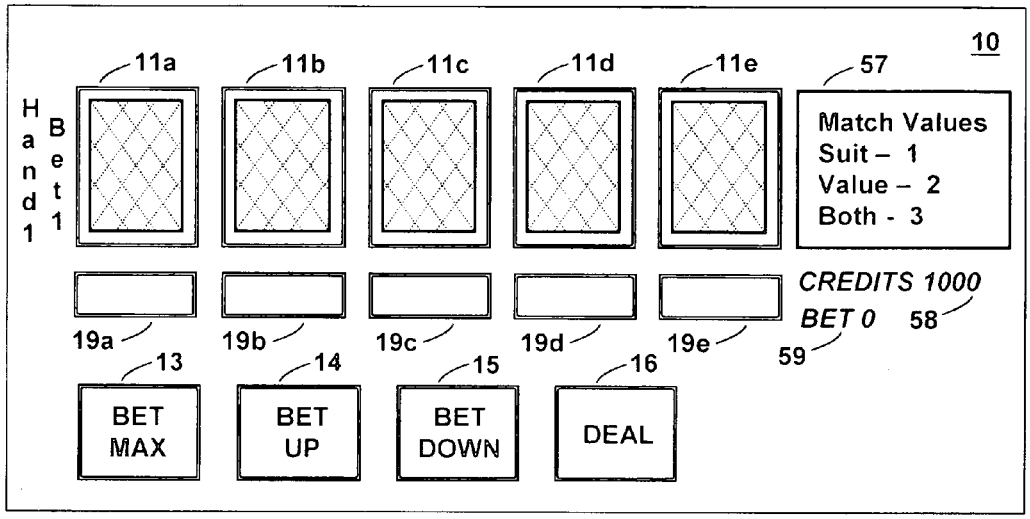
FIG. 1 shows the screen of a video draw poker game with card positions for the conventional draw poker cards, and positions for the additional five card match hand used to determine additional "Match Poker" winnings.

The present invention combines the most desirable features of draw poker and gaming machines such as slot machines with a novel improvement that gives a player more sense of participation and control, reasonable odds of winning, and what the players perceive is a chance to beat odds that are normally in favor of casino. For poker the result is a more desirable draw poker game called "Match Poker". The more desirable version on a slot machine is called "Match Slots".

For Match Poker the improvement is achieved by initially dealing a player a five card draw poker hand plus an additional five card match hand that may yield the player additional game winnings. A player selects cards to be held, and non-held cards are replaced in a conventional fashion during a draw step to get a final five card draw poker hand that determines what winnings the player has achieved. The player may achieve the additional game winnings in the following manner. The cards of the final five card draw poker hand are compared to the cards of the additional match hand for matches of face value and suit. That is, the first card in the final draw poker hand is compared to the first card in the match card hand, the second card in the draw card poker hand is compared to the second card in the match card hand, and so on to the fifth card in the draw poker hand being compared to the fifth card in the match card hand. Additional game winnings are achieved for each match in face value and in suit. When in each comparison the suit is the same there is an additional winning of one credit. When in each comparison the face value is the same there is an additional winning of two credits. When in each comparison both the face value and the suit are the same there is an additional winning of three credits. This novel game play is called "Match Poker". This embodiment of the invention is shown and described with reference to FIGS. 4-7.

In an alternative embodiment of the draw poker version of the invention two initial five card draw poker hands are dealt plus the additional five card match hand. The two five card draw poker hands are played one after the other. The conventional draw poker winnings are determined for each of the two draw poker hands, and the additional five card match hand is compared to the each of the two initial five card draw poker hands to determine suit and face value matches between the hands for additional game winnings. This alternative embodiment of the invention is shown and described with reference to FIGS. 8-13.

In another embodiment of the invention implemented with a video slot machine, a player places their bet(s) and actuates the spin of video slot reels in a manner well known in the art. One or more conventional rows of slot symbols are displayed, plus another match row of slot symbols used to implement the match concept of the present invention. The conventional rows of slot symbols are analyzed for winnings in a well known manner. Then the conventional rows of slot symbols are each compared to the match row of slot symbols to determine any matches which indicate additional game winnings. This embodiment of the invention is shown and described with reference to FIG. 17.

In FIG. 1 is shown a display screen 10 of a computer controlled video implementation of the novel Match Poker game for playing a single poker hand in accordance with the teaching of the present invention. Some standard features of a slot machine that are well known in the art are deliberately not shown in FIG. 1 to avoid detracting from the teaching of the present invention and to avoid cluttering the drawing.

Figure 16:
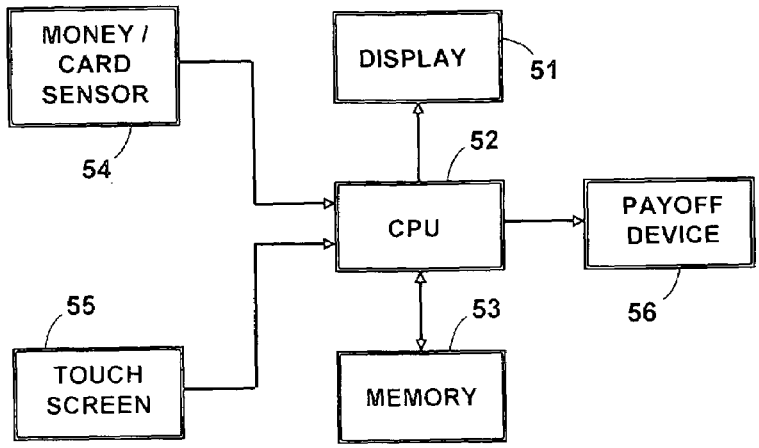
FIG. 16 shows a general block diagram of a video gaming system used to implement the computer controlled video implementation of the Match Poker game.

Typically there is a slot for inserting coins or tokens to place a number of wagers or bets for a round of game play. In addition, there may be a slot for the insertion of a debit card from which the game debits the number of wagers or bets placed by a player, and to which the game credits any winnings. Such wagers or bets from a debit card are often referred to as credits and this is the term used throughout this detailed description. These slots are shown as Money/Card Sensor 54 in FIG. 16. Also, when there is a slot for insertion of coins or tokens there will be a tray into which winnings in the form of coins or tokens are dispensed. In addition, if there is a slot for inserting a debit card to bet on a round of game play that same slot is used to credit winnings to the debit card. Those slots and tray are shown as Payoff Device 56 in FIG. 16. The video screen display 51 may include information such as, but not limited to, copyright and trademark notices, manufacturer of equipment, name of game, and fancy graphics. FIG. 16 is described in detail further in this detailed description. There may be a flashing light on the top of the game housing to announce a winning jackpot; and there may be other controls. Also included on the front panel of the game housing may be game instructions to instruct a player as to how to play the Match Poker game and preferably instructions on the video display screen 10 indicating what action is required by the player at particular times during game play. The Match Poker game instructions may also be called up and displayed by touching an on-screen button (not shown). These other elements form no specific part of the present invention.

In FIG. 1 there are shown five card display positions 11*a*-11*e* in which cards are dealt to play the novel Match Poker version of draw poker. These five card positions are also referred to in this Detailed Description as Hand 1. There are also five additional card display positions 19*a*-19*c* in which five additional cards are dealt to implement the matching card aspect of the present invention. These five card positions are also referred to in this Detailed Description as Match Hand 19. There are four on-screen buttons shown. There is a Bet Max button 13 which a player will touch to indicate the maximum possible number of bets on a round of game play. There is a Bet Up button 14 that a player will touch to incrementally increase their bets prior to the start of game play. There is a Bet Down button 15 that a player will touch to incrementally decrease their bets prior to the start of game play. There is also a DEAL button 16 that a player touches to commence Match Poker game play after they have placed their bets. Other commonly shown buttons are not shown because they are well known in the prior art and to avoid detracting from the description of the invention. In FIG. 1 only the backs of cards are shown in card positions 11*a*-11*e* because a player has not yet placed any bets and touched DEAL button 16.

There is also an on-screen display 58 of the number of credits a player has to play, and an on-screen display 59 of the number of bets a player is placing on each round of game play. Finally, there is an on-screen display 57 of the number of additional credits a player may win when there is a match between the face value and suit of the dealt cards displayed in positions 11*a*-11*e* (Hand 1) and the match cards that are dealt into display positions 19*a*-19*e* (Match Hand). To determine match winnings the face value and suit of the final card dealt or drawn into position 11*a* is compared to the face value and suit of the match card dealt into match card display position 19*a* and so forth to the face value and suit of the card dealt or drawn into position 11*e* being compared to the face value and suit of the match card dealt into card display position 19*e*. As shown in display 57 when there is a match in the suit (hearts, diamonds, spades or clubs) of a card in one of positions 11*a*-11*e* (Hand 1) and a corresponding one of the cards in positions 19*a*-19*e* (Match Hand 19) an additional winning of one credit is achieved. Similarly, when there is a match in the face value of a card in one of positions 11*a*-11*e* and a corresponding one of the match cards in positions 19*a*-19*e* an additional winning of two credits is achieved. Finally, when there is a match in both the suit and the face value of a card in one of positions 11*a*-11*e* and a corresponding one of the match cards in positions 19*a*-19*e* an additional winning of 3 credits is achieved. Alternatively, the same number or a different number of credits may be won for each face value or suit match. The match hand credit payout may be also be determined differently, such as being a multiplier of the winnings from the pay table in FIG. 3.

Figure 2:
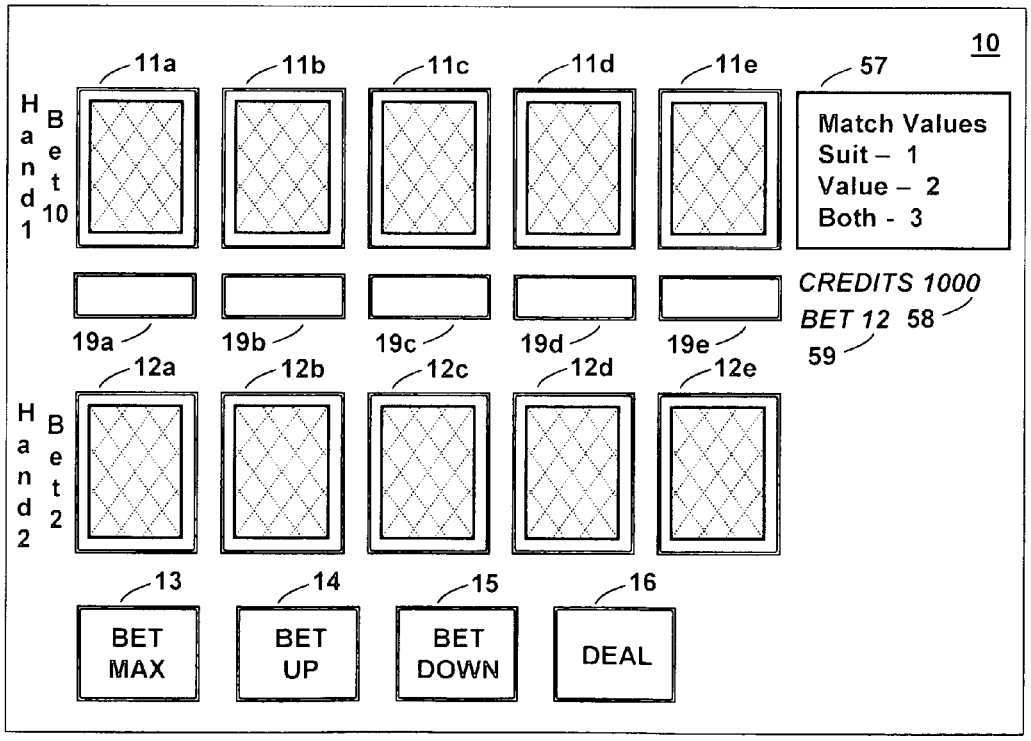
FIG. 2 shows the screen of an electronic draw poker game with card positions for two hands of conventional draw poker to be played sequentially, and positions for the additional five card match hand used to determine additional "Match Poker" winnings for both draw poker hands.

In FIG. 2 is shown the display screen 10 of a computer controlled video implementation of the novel Match Poker game as played on a video slot machine when two poker hands are sequentially played in accordance with the teaching of an alternative embodiment of the invention. As described above some standard features typically displayed on display screen 10 are not shown to avoid detracting from the teaching of the present invention and to avoid cluttering the drawing.

A player may place a bet of up to 10 credits on each of Hand 1 and Hand 2 in FIG. 2. When a player touches Bet Up button 14 to place a number of bets between one and ten, the video screen will appear as in FIG. 1. When the player touches Bet Up button 14 an eleventh time video screen 10 changes to appear as in FIG. 2 and display a second hand—Hand 2. As shown in FIG. 2, at the left of hands 11 and 12 is an indication that the hand is either Hand 1 or Hand 2 and the number of bets placed on each hand. In FIG. 2 the player has placed a total of 12 bets, the maximum number of ten of which are placed on Hand 1 and the remaining two bets are placed on Hand 2. As each bet is placed one credit is deducted from the number of player credits displayed at position 58. The total number of bets placed by a player, twelve in this example, is displayed at position 59. In FIG. 2 only the backs of cards are shown in card positions 11*a*-11*e* and 19*a*-19*e* because a player has not yet placed any bets and touched DEAL button 16. In variant games a player may choose to place less than ten bets on the first hand of cards 11*a*-11*e* and then choose to place any number of bets on the second hand of cards 12*a*-12*e*.

In FIG. 3 is shown a typical pay table showing the credit winnings a player may achieve for different winning hands of cards based on the number of bets placed on a hand of cards. For example, in FIG. 1, the player has placed a total of 10 bets on Hand 1. If the player in this a round of game play gets a full house the player will win a total of seventy credits. Each hand of cards will have its own winnings apart from the match winnings described briefly above and in more detail hereinafter.

First Round of Game Play

Figure 4:
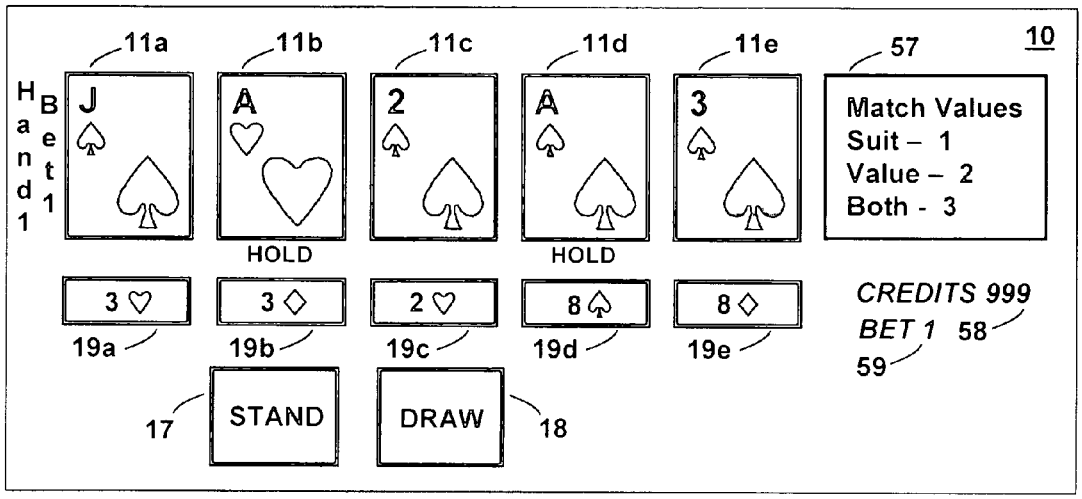
FIG. 4 shows the first steps for a first round of game play of Match Poker in which only a single hand of cards are dealt to play draw poker.
Figure 5:
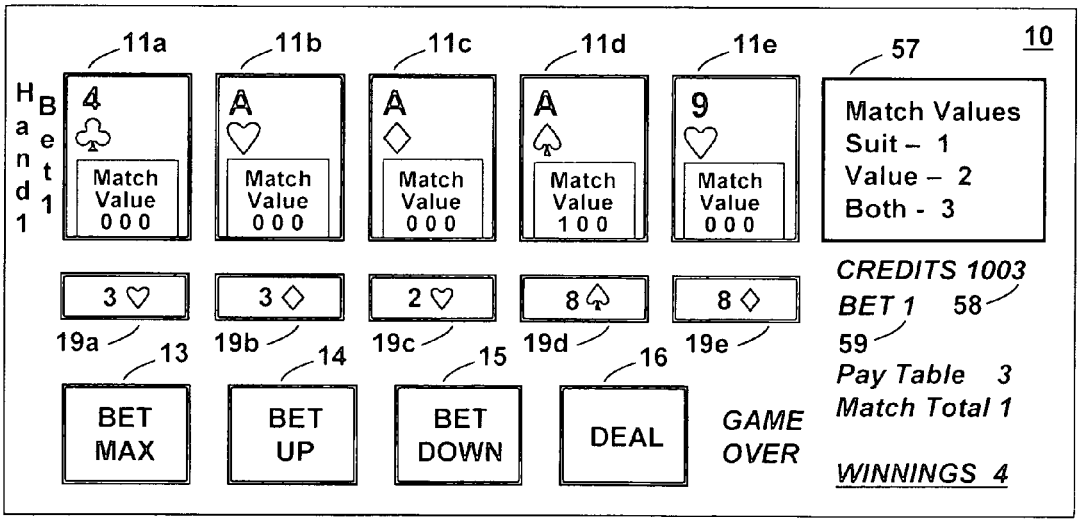
FIG. 5 shows the final steps for the first round of game play of Match Poker including determining match winnings.

FIGS. 4 and 5 are utilized to illustrate a first round of game play in accordance with the teaching of the invention, but game play actually begins in FIG. 1 with the placing of bets and touching DEAL button 16. After DEAL button 16 is touched, buttons 13-16 in FIG. 1 are deleted and are replaced by STAND button 17 and DRAW button 18 in FIG. 4 to be used in the next step of game play. For this first round of game play only a single bet is placed by a player as indicated by "Bet 1" in display area 59. Each bet is equal to one credit. Bet 1 is also displayed at the left side of Hand 1. With only one bet being placed the player's credits are reduced from 1000 to 999 as indicated at position 58. After the player touches on-screen Bet Up button 14 in FIG. 1 once to place the one bet, and then touches on-screen button DEAL 16, a hand of cards is randomly dealt into positions 11*a*-11*e* as shown in FIG. 4. In addition, in accordance with the teaching of the invention, an additional hand of five cards is dealt into Match Hand 19 display positions 19*a*-19*e* as shown in FIG. 4. The Match Hand cards are used to determine additional winnings for a player per Match Values table 57.

The initial Hand 1 of five cards dealt into card display positions 11*a*-11*e* in FIG. 4 are analyzed by the player to determine what cards are to be held and what cards are to be disposed of and replaced. In this first round of game play the player chooses to hold the ace of hearts in position 11*b* and the ace of spades in position 11*d*. The player selects these two cards by touching them on display screen 10 which is equipped with touch screen technology that is well known in the art. Responsive to being touched the word HOLD is displayed under the aces in display positions 11*b* and 11*d*. The player may change their mind and retouch either or both of the two aces to remove the held status, and then touch other cards to be held. If the player wishes to hold all cards they can just touch STAND button 17 and the game play progresses to analyzing the cards in Hand 1 for winnings.

After the player is finished holding cards they touch DRAW button 18. Immediately after a player placed bets and touched DEAL button 16 in FIG. 1, buttons 13-16 are replaced by STAND button 17 and DRAW button 18 as shown in FIG. 4. Responsive to DRAW button 18 being touched the non-held cards in positions 11*a*, 11*c* and 11*e* are replaced as shown in FIG. 5. The player's final Hand 1 is shown in FIG. 5 and comprises three aces, a four and a nine. Per the pay table shown in FIG. 3, with one bet placed, three of a kind wins three credits. The final hand of cards in Hand 1 are then analyzed using the pay table in FIG. 3 and the number of bets placed by the player to determine what the winnings are.

At this point in game play buttons 17 and 18 disappear and are replaced by buttons 13-16 on display 10 in FIG. 5 in preparation for a second round of game play. A second round of game play with one hand is described with reference to FIGS. 6 and 7.

In accordance with the teaching of the invention the final step in a round of game play of the novel Match Poker game is to determine any match winnings for the first round of game play using the additional five cards dealt into Match Hand 19 (positions 19*a*-19*e*). The match process consists of comparing cards in positions 11*a*-11*e* with cards in positions 19*a*-19*e*. More particularly, in FIG. 5 the card displayed in position 11*a* is compared with the card in position 19*a*, the card displayed in position 11*b* is compared with the card displayed in position 19*b*, and so forth to the card displayed in position 11*e* being compared to the card displayed in position 19*e*.

More particularly, in comparing the five cards of Hand 1 and Match Hand 19 it is determined if there is a suit or face value match between the cards displayed in positions 11*a* and 19*a*, if there is a suit or face value match between the cards displayed in positions 11*b* and 19*b*, if there is a suit or face value match between the cards displayed in positions 11*c* and 19*c*, if there is a suit or face value match between the cards displayed in positions 11*d* and 11*d*, and if there is a suit or face value match between the cards displayed in positions 11*e* and 19*e*. There is an ace of spades in position 11*d* and an eight of spades in position 19*d*. Thus, there is only one suit match. There are no face value matches between the cards in the two hands 11 and 19. Per the Match Values table 57 each suit match wins one credit. Thus, the player has won one additional credit for the first round of game play. In total, the player has won a total of four credits, three credits per the pay table in FIG. 3 for the three aces, and one credit for having one suit match. These winnings are shown in the lower right corner of display 10 of FIG. 5 as "Winnings 4". The player's credit total in position 58 is increased by four from 999 to 1003 as shown in FIG. 5 to reflect these winnings. The first round of game play is completed.

Figure 7:
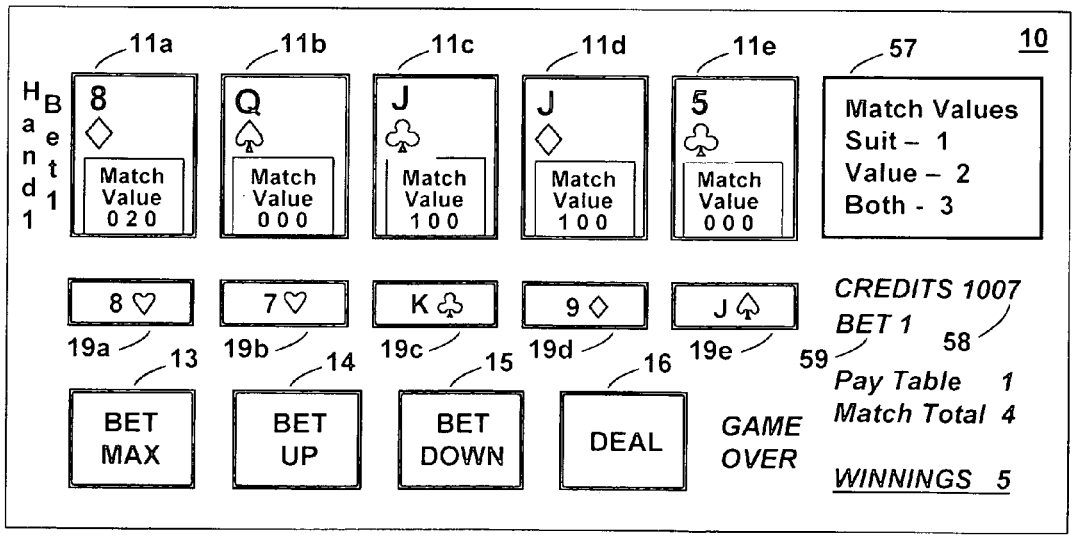
FIG. 7 shows the final steps for the second round of game play of Match Poker including determining match winnings.

To display the match information to the player a small window is displayed in the bottom portion of each of card positions 11*a*-11*e* as shown in FIG. 5. Each of these small windows is entitled Match Value and a three digit number is displayed under the title. The first digit indicates if there is a suit match, the second digit indicates if there is a face value match, and the third digit indicates if there is both a suit and face value match. The value of a digit indicates the number of additional credits won. Per table 57 each suit match yields one additional credit, each value match yields two additional credits, and both a suit and value match yields three additional credits. Accordingly, with no suit or face value match for the cards displayed in positions 11*a* and 12*a* the three numbers are "000". The same applies to the small window displayed in positions 11*b*, 11*c* and 11*e*. In position lid the number "100" is displayed reflecting that there is a suit match of spades. A suit match receives only one credit. If "020" is displayed it would indicate a face value match because face value matches are displayed in the second position, and a face value match receives two credits as indicated in table 57. This is shown in FIG. 7 for the match winnings for a second round of game play. If "003" is displayed it would indicate both a face value and suit match because both face value and suit matches are displayed in the third position, and receive three credits as indicated in table 57.

Second Round of Game Play

Figure 6:
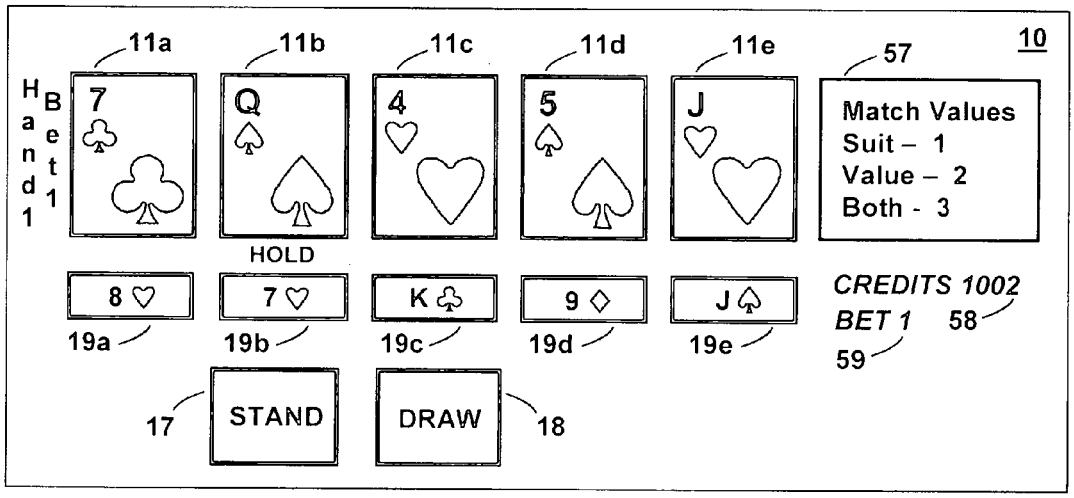
FIG. 6 shows the first steps for a second round of game play of Match Poker in which only a single hand of cards are dealt to play draw poker.

FIGS. 6 and 7 are utilized to illustrate a second round of game play in accordance with the teaching of the invention in which only a single bet is placed by a player as indicated by "Bet 1" in display area 59 and at the left of Hand 1. The second round of game play actually commences using on-screen buttons 13-16 displayed in FIG. 5. The player will select the number of bets they wish to place on the second round of game play in one of two ways. They may use Bet Max button 13, Bet Up button 14 and Bet Down button 15 in a well known manner. Alternatively, if the player does not use bet buttons 13-15 and touches DEAL button 16 the game program assumes that the player wishes to repeat the number of bets placed on the previous round of game play into the present round of game play. That is the case described for the second round of game play. The player touches DEAL button 16 in FIG. 15 and starts the second round of game play without increasing or decreasing their bets. Whichever way the number of bets are determined for the second round of game play, in FIG. 6 the number of bets is displayed at location 59. With one bet being placed the player's credits are decreased from the 1003 shown in FIG. 5 at the end of the first round of game play to the 1002 credits shown in space 58 in FIG. 6.

In FIG. 6, for the second round of game play the five cards shown in Hand 1 are dealt into positions 11*a*-11*e* and the match cards are dealt into Match Hand 19 as shown. As previously described the player analyzes Hand 1 to determine what cards they want to hold and what cards they want to discard and replace. In this example the player chooses to hold only the queen of spades in position 11*b* so the player touches position 11*b* and the word "HOLD" is displayed under the queen of spades as shown. The player may alternatively decide to hold all their cards and they will touch STAND button 17. In that instance no cards are discarded and replaced and game play progresses to determine any winnings from the pay table in FIG. 3, and then to determine any match winnings.

After the player elects to hold only the queen of spades in position 11*b* they touch DRAW button 18 to replace the non-held, discarded cards in the other positions. The display changes to that shown in FIG. 7. Buttons 17 and 18 disappear and are replaced by buttons 13-16. This is done in preparation for the next round of game play. As shown in FIG. 7 the discarded seven of clubs in position 11*a* of FIG. 6 is replaced by the eight of diamonds, the discarded four of hearts in position 11*c* of FIG. 6 is replaced by the jack of clubs, the discarded five of spades in position 11*d* of FIG. 6 is replaced by the jack of diamonds, and the discarded jack of hearts in position 11*e* of FIG. 6 is replaced by the five of clubs.

The game program analyzes the final five cards in Hand 1 of FIG. 7 to determine if there is a winning hand. In this case there is a pair of jacks which is jacks or better and, per the pay table in FIG. 3, yields a winning of one credit for a bet of one credit. This is displayed in the lower right corner of display 10 as "Pay Table—1"

the game program then determines if there are any match winnings for the second round of game play using the additional five match cards dealt into Match Hand 19 (positions 19*a*-19*e*). This match process consists of comparing cards of Hand 1 in positions 11*a*-11*e* with corresponding cards in positions 19*a*-19*e* as previously described with reference to the first round of game play. In comparing the five cards in Hand 1 and Match Hand 19 it is determined if there is a suit or face value match between the cards displayed in positions 11*a* and 19*a*, if there is a suit or face value match between the cards displayed in positions 11*b* and 19*b*, if there is a suit or face value match between the cards displayed in positions 11*c* and 19*c*, if there is a suit or face value match between the cards displayed in positions 11*d* and 19*d*, and if there is a suit and face value match between the cards displayed in positions 11*e* and 19*e*.

There is an eight of diamonds in position 11*a* and an eight of hearts in position 19*a*. Thus, there is a face value match which, per the Match Values table 57, wins two credits. In addition, there is a jack of clubs in position 11*c* and a king of clubs in position 19*c* which yields an additional winning of 1 credit per table 57 due to the match in card suit. Also, there is a jack of diamonds in position 11*d* and a nine of diamonds in position 19*d* which also yields an additional winning of 1 credit per table 57 due to the match in card suit. Thus, the player has won four additional credits due to matches. These are displayed in the lower right corner of display 10 as "Match Total—4".

In total, the player has won a total of five credits for the second round of Match Poker game play, one credit for the pair of jacks or better, two credits for having one face value match, and two credits for having two suit matches. These winnings are shown in the lower right corner of display 10 of FIG. 7 as "Winnings 5". The player's credit total in position 58 is increased by five from 1002 to 1007 in FIG. 7 to reflect these winnings.

To display the match information to the player a small window is displayed in the bottom portion of each of card positions 11*a*-11*e* as shown in FIG. 7. Each of these small windows is entitled Match Value and a three digit number is displayed under the title. The first number indicates if there is a suit match, the second number indicates if there is a face value match, and the third number indicates if there is both a suit and face value match. Accordingly, with no suit or face value match for the cards displayed in positions 11*b* and 12*b* and in positions 11*e* and 12*e* the three numbers displayed in positions 11*b* and 11*e* are "000". In position 11*a* the number "020" is displayed reflecting that there is a face value match of eight which receives two credits as indicates in table 57. The two is displayed in the second position of the three digit number. In positions 11*c* and 19*c* there is a suit match of clubs, and in positions 11*d* and 19*d* there is a suit match of diamonds. Per Match Values table 57 this results in receiving two more credits. The second round of game play is completed.

Third Round of Game Play

Figure 8:
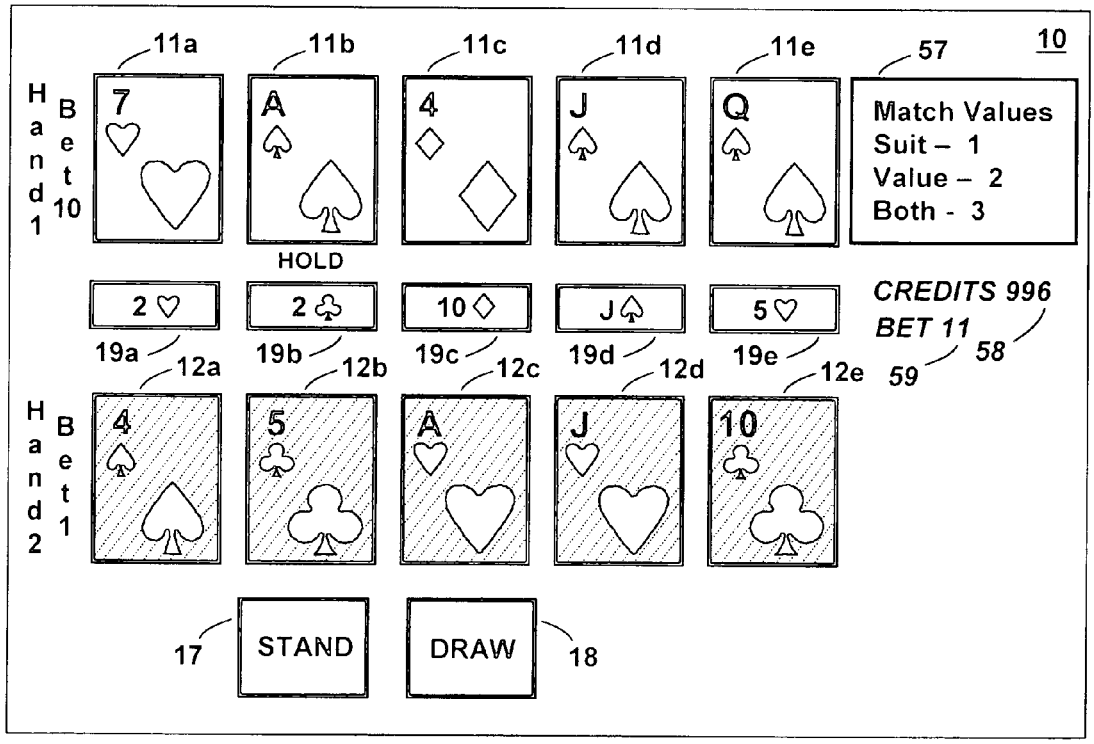
FIG. 8 shows the first steps for a third round of game play of Match Poker in which two hands of cards are dealt to play draw poker and match winnings may be achieved for both hands.
Figure 9:
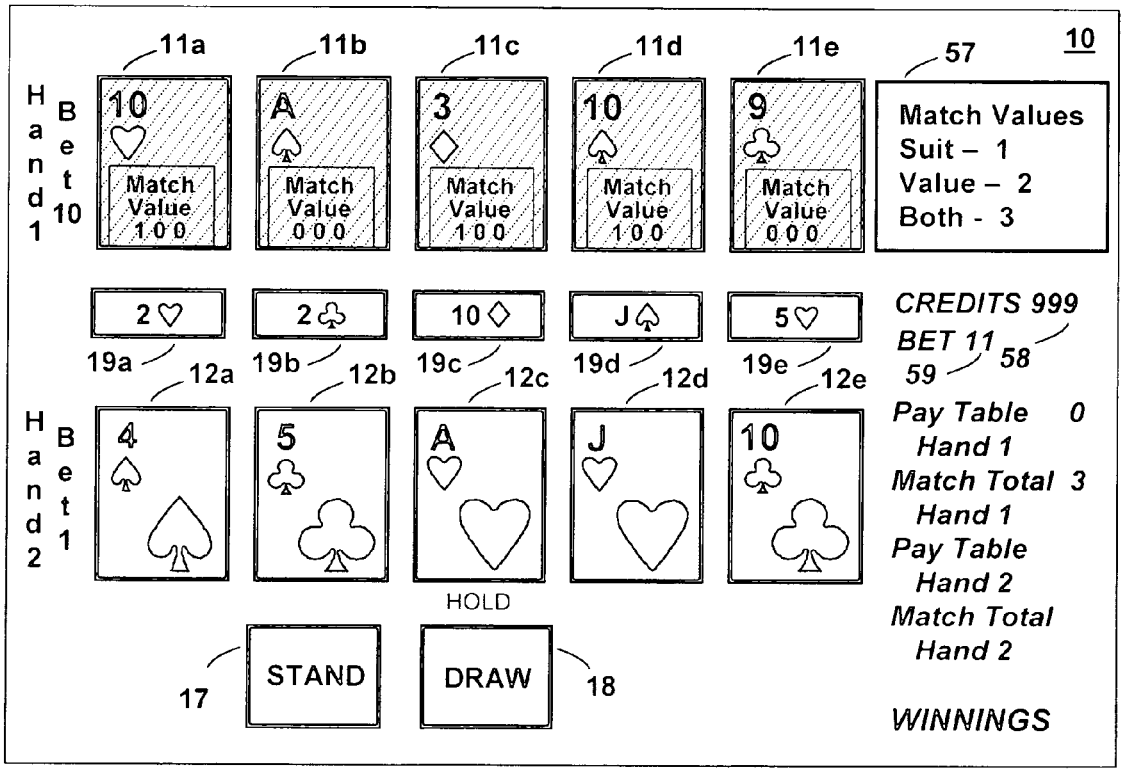
FIG. 9 shows the intermediate steps for the third round of game play of Match Poker.
Figure 10:
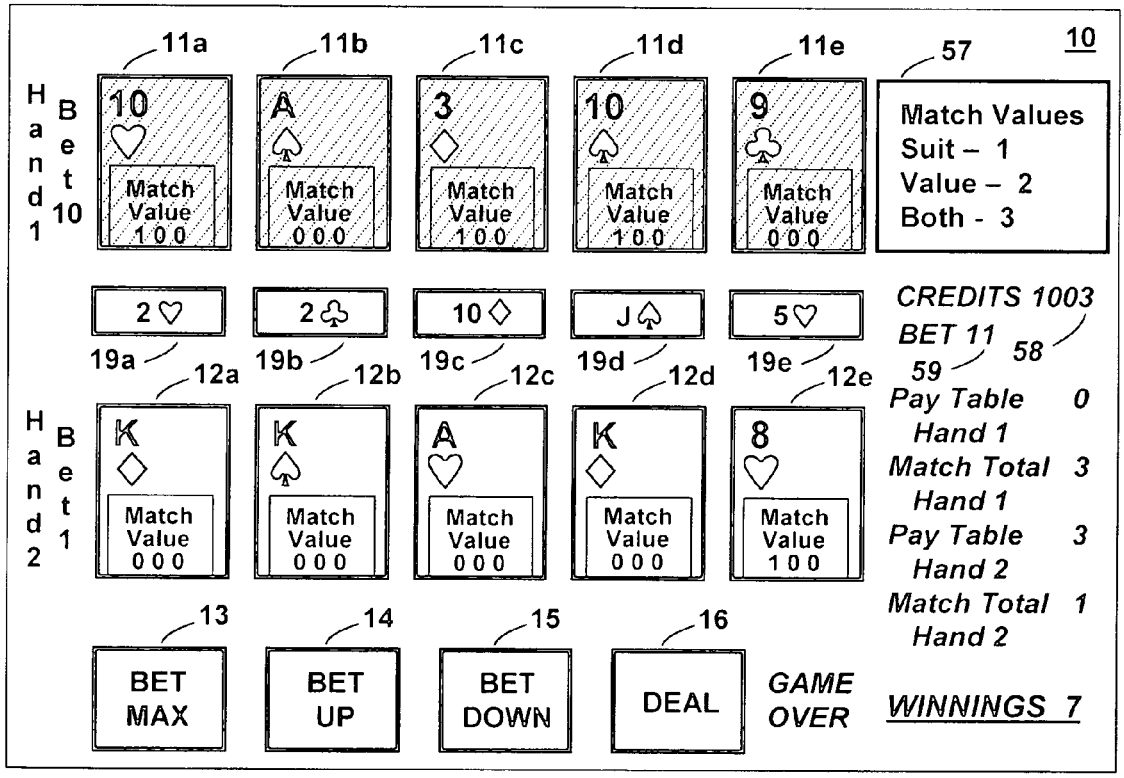
FIG. 10 shows the final steps of for the third round of game play of Match Poker.

FIGS. 8 through 10 are utilized to illustrate a third round of game play in which eleven bets are placed by a player as indicated by "Bet 11" in display area 59. Since only a maximum of ten bets may be played on a single hand, ten bets are placed on Hand 1 and a second hand is displayed entitled Hand 2 on which the eleventh bet is placed. If the player had placed fifteen bets there would be ten bets on Hand 1 and five bets on Hand 2. The number of bets placed on each hand is displayed just to the left of each hand. To the left of Hand 1 is displayed "Bet 10" and to the left of Hand 2 is displayed "Bet 1". In an alternative embodiment of the invention the same number of bets may be placed on each of the two hands 11 and 12.

The third round of game play commences using on-screen buttons displayed in FIG. 7 at the end of the second round of game play. Those are buttons 13-16 that are re-displayed on display 10 in FIG. 7 after DRAW button 18 is touched in FIG. 6. The player selects the number of bets they wish to place on the third round of game play in one of two ways. They may use Bet Max button 13, Bet Up button 14 and Bet Down button 15 in a well known manner and as previously described for the first and second round of game play. Alternatively, if the player does not use buttons 13-15 and touches DEAL button 16 in FIG. 7 the game program assumes that the player wishes to repeat the number of bets placed on the previous round of game play into the present round of game play. The player touches DEAL button 16 in FIG. 7 and starts the third round of game play. Whichever way the number of bets are determined for the third round of game play, in FIG. 8 the number of bets is displayed to the left of Hand 1 and Hand 2 and in location 59. With eleven bets being placed the player's credits displayed at location 58 are decreased from the 1007 shown in FIG. 7 at the end of the second round of game play to the 996 credits shown in location 58 in FIG. 8.

In FIG. 8, for the third round of game play the five cards shown in Hand 1 are dealt into positions 11*a*-11*e*, the five cards shown in Hand 2 are dealt into positions 12*a*-12*e* and the match cards shown are dealt into Match Hand positions 19*a*-19*e*. Hands 1 and 2 are played sequentially so the display of Hand 2 is initially suppressed or grayed somewhat as depicted in FIG. 8 to indicate to the player that Hand 2 is presently not in play. The player analyzes Hand 1 to determine what cards they want to hold and what cards they want to discard and replace. In this example the player chooses to hold the ace of spades in position 11*b* so the player touches position 11*b* in FIG. 8 and the word "HOLD" is displayed under the ace of spades as shown. The player may alternatively decide to hold all cards and touch STAND button 17. In that instance no cards are discarded and replaced and game play progresses to the next step as displayed in FIG. 9.

After electing to hold the ace of spades the player touches DRAW button 18 to discard and redraw cards and the game program displays screen 10 as shown in FIG. 9. The cards in display positions 11*a*, 11*c*, 11*d* and 11*e* of Hand 1 in FIG. 8 are replaced as shown in FIG. 9. In addition, the Match Value windows are displayed in the lower portion of each of positions 11*a*-11*e*.

The game program analyzes the final five draw poker cards in Hand 1 of FIG. 9 to determine if there is a winning hand. In this case there is only a pair of tens so there are no draw poker game winnings for Hand 1. This is reflected in the lower right area of display 10 by the words "Pay Table Hand 1-0".

The game program then determines if there are any match winnings for Hand 1 in the third round of game play using the additional five cards dealt into Match Hand 19 (positions 19*a*-19*e*). This match process consists of comparing cards of Hand 1 in positions 11*a*-11*e* with corresponding cards in positions 19*a*-19*e* as previously described.

For Hand 1 in the third round of game play there are no face value matches but there are three suit matches. There is: (a) a ten of hearts in position 11*a* and a two of hearts in position 19*a*, (b) a three of diamonds in position 11*c* and a ten of diamonds in position 19*c*, and (c) a ten of spades in position 11*d* and a jack of spades in position 19*d*. Per Match Value table 57 three suit matches yields additional winnings of three credits for the player. Accordingly, the numbers displayed in the Match Value windows in positions 11*a*, 11*c* and 11*d* read "100". In addition, at the lower right corner of display 10 is now displayed pay table winnings of zero as the words "Match Total Hand 1-3". Since only game play for Hand 1 has been completed thus far in the third round of game play only the winnings for Hand 1, as described above, are displayed. Since Hand 2 has not yet been played no winnings are displayed for that hand.

Since game play is completed for Hand 1, and Hand 2 is now to be played, the suppression or graying of display position 12*a*-12*e* of Hand 2, as depicted in FIG. 9, is removed indicating that Hand 2 is now in play and, instead, display positions 11*a*-11*e* of Hand 1 are suppressed or grayed indicating that Hand 1 is no longer in game play.

Game play now progresses to play Hand 2 and this is now described with reference to FIGS. 9 and 10. The player must initially analyze Hand 2 to determine what cards they want to hold and what cards they want to discard and replace. In this example the player chooses to hold the ace of hearts in position 12*c* so the player touches position 12*c* on display 10 in FIG. 9 and the word "HOLD" is displayed under the ace of hearts as shown. The player then touches DRAW button 18 to discard and redraw cards that are shown in FIG. 10. The player may alternatively decide to hold all cards and touch STAND button 17. In that instance no cards are discarded and replaced and game play would progress to the next step.

In FIG. 10 it is seen that a king of diamonds is drawn into position 12*a*, a king of spades is drawn into position 12*b*, a king of diamonds is drawn into position 12*d*, and an eight of hearts is drawn into position 12*e* of Hand 2. This definitely improved Hand 2. The game program analyzes the final five cards in Hand 2 of FIG. 10 to determine if there is a winning hand. There are three kings in positions 12*a*, 12*b* and 12*d*. Per the pay table in FIG. 3 three of a kind with a bet of one wins three credits. This winning is displayed in the lower right corner of display 10 as "Pay Table Hand 2-3".

The game program then determines if there are any match winnings for Hand 2 in the third round of game play using the additional five match cards dealt into Match Hand 19 (positions 19*a*-19*e*). This match process consists of comparing cards of Hand 1 in positions 11*a*-11*e* with corresponding cards in positions 19*a*-19*e* as previously described.

For Hand 2 in the third round of game play there are no face value matches but there is one suit match. There is an eight of hearts in position 12*e* and a five of hearts in position 19*e*. Per Match Value table 57 one suit match yields a winning of one credit. Accordingly, the numbers displayed in the Match Value window in position 11*e* reads "100". The Match Value window for positions 12*a*, 12*b*, 12*c* and 12*d* read "000". The match value winning is displayed in the lower right corner of display 10 as "Match Total Hand 2-1". The third round of game play is now over and the total game winnings are also displayed in the lower right corner of display 10 as "Winnings 7". The player's credits in position 58 are incremented by four additional credits from 999 to 1003.

Fourth Round of Game Play

Figure 11:
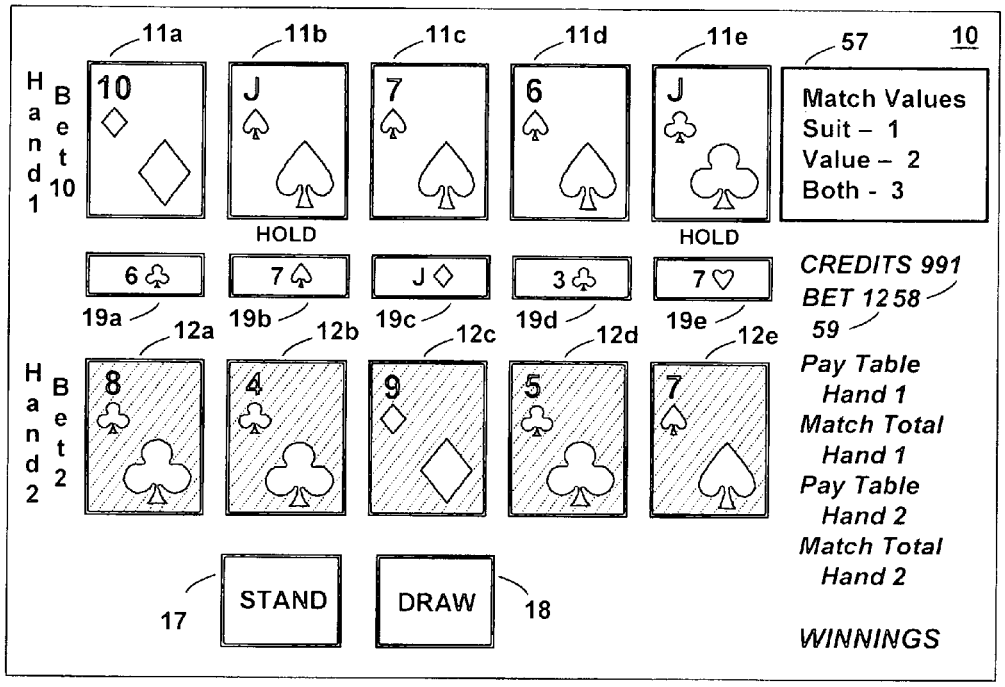
FIG. 11 shows the first steps for a fourth round of game play of Match Poker in which two hands of cards are dealt to play draw poker and match winnings may be achieved for both hands.
Figure 12:
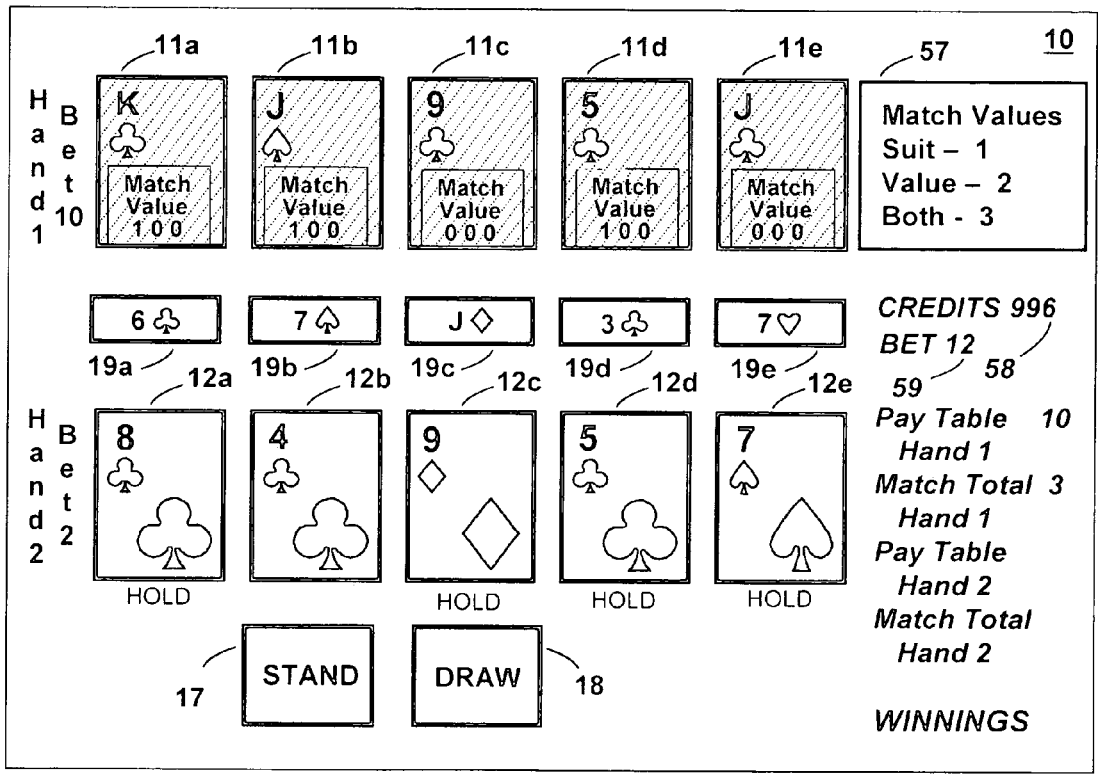
FIG. 12 shows the intermediate steps for the fourth round of game play of Match Poker.
Figure 13:
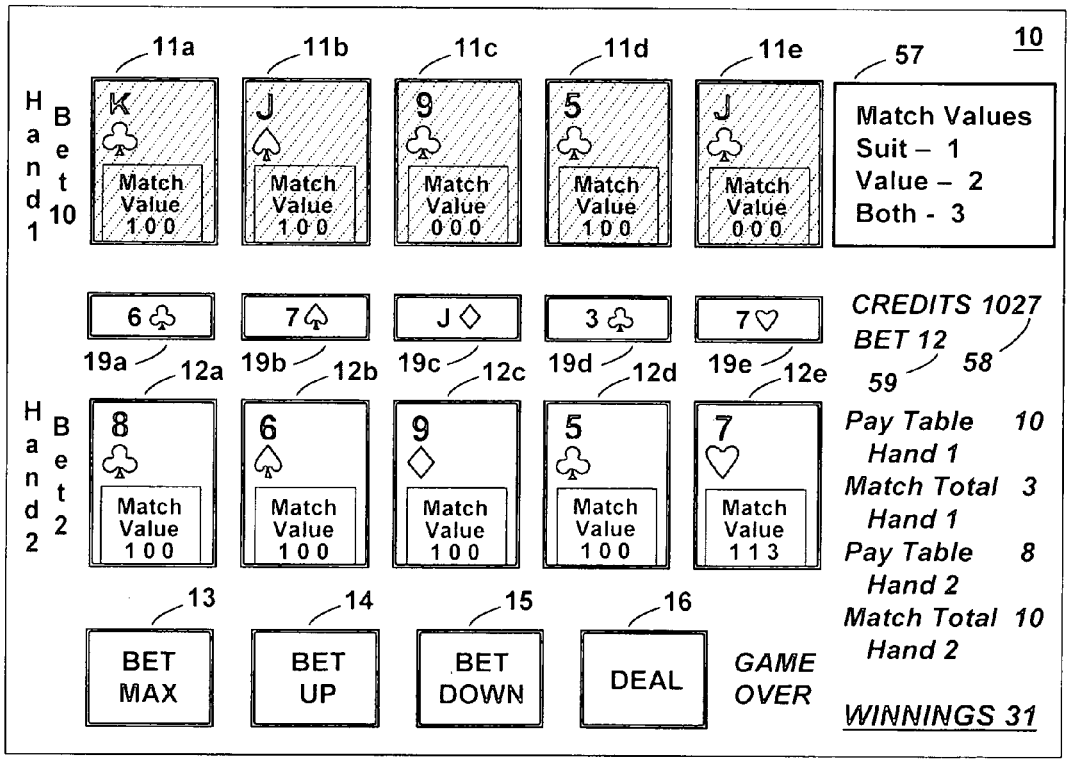
FIG. 13 shows the final steps of for the fourth round of game play of Match Poker.

FIGS. 11 through 13 are utilized to illustrate a fourth round of game play of Match Poker in which twelve bets are placed by a player as indicated by "Bet 12" in location 59. Since eleven bets had been placed on the third round of game play the player has to touch Bet Up button 14 in FIG. 10 once after the third round of game play is over to increase the bets by one to twelve. Since only a maximum of ten bets may be played on a single hand, ten bets are placed on Hand 1 and the other two bets are placed on Hand 2. The number of bets placed on each hand is displayed just to the left of each hand. To the left of Hand 1 is displayed "Bet 10" and to the left of Hand 2 is displayed "Bet 2".

The fourth round of game play commences using on-screen buttons 13-16 16 displayed in FIG. 10 at the end of the third round of game play. The bets are changed, such as described in the previous paragraph, using buttons 13-15. In FIGS. 11-13 the number of bets are displayed to the left of the display of Hand 1 and Hand 2 and in location 59. With twelve bets being placed the player's credits displayed at location 58 are decreased from the 1003 shown in FIG. 10 at the end of the third round of game play to the 991 credits shown in location 58 in FIG. 11. The player then touches DEAL button 16 in FIG. 10 to start the fourth round of game play.

In FIG. 11, for the fourth round of game play the five cards shown in Hand 1 are dealt into positions 11*a*-11*e*, the five cards shown in Hand 2 are dealt into positions 12*a*-12*e* and the match cards shown are dealt into Match Hand 19 (positions 19*a*-19*e*). Hands 1 and 2 are played sequentially in that order so the display of Hand 2 is initially suppressed or grayed somewhat as depicted in FIG. 11 to indicate to the player that Hand 2 is presently not in play. The player analyzes Hand 1 to determine what cards they want to hold and what cards they want to discard and replace. In this example the player chooses to hold the jack of spades in position 11*b* and the jack of clubs in position 11*e* so the player touches positions 11*b* and 11*e* in FIG. 11 and the word "HOLD" is displayed under these two positions as shown. The player may change their HOLD selections by retouching a position to remove the HOLD. Under different circumstances the player may alternatively decide to hold all cards and touch STAND button 17. In that instance no cards are discarded and replaced and game play progresses to the next step as displayed in FIG. 12.

After electing to hold the two jacks in positions 11*b* and 11*e* the player touches DRAW button 18 in FIG. 11 and the game program displays screen 10 as shown in FIG. 12. The cards in display positions 11*a*, 11*c* and 11*d* of Hand 1 in FIG. 11 are replaced as shown in FIG. 12 with the king of clubs, the nine of clubs and the five of clubs. In addition, the Match Value windows are displayed in the lower portion of each of positions 11*a*-11*e* in FIG. 12.

The game program analyzes the final five cards in Hand 1 of FIG. 12 to determine if there is a winning match poker hand. In this case there is a pair of jacks so there are winnings for jacks or better in Hand 1. Per the pay table in FIG. 3 jacks or better with ten bets wins ten credits. These ten credits are displayed in the lower right corner of display 10 as "Pay Table Hand 1-10".

The game program then determines if there are any match winnings for Hand 1 in the fourth round of game play using the additional five cards dealt into Match Hand 19 (positions 19*a*-19*e*). This match process consists of comparing cards of Hand 1 in positions 11*a*-11*e* with corresponding cards in positions 19*a*-19*e* of Match Hand 19 for face value and suit matches as previously described.

For Hand 1 in the third round of game play there are three suit matches in positions 11*a*, 11*b* and 11*d*. Per Match Values table 57 three suit matches yields winnings of three credits for the player. Accordingly, the numbers displayed in the Match Value windows in positions 11*a*, 11*b* and 11*d* read "100". There are no face value matches. In addition, at the lower right corner of display 10 is now displayed match winnings for Hand 1 as "Match Total Hand 1-3". Since only game play for Hand 1 has been completed thus far in the fourth round of game play only the winnings for Hand 1 are displayed.

Since game play is completed for Hand 1, and Hand 2 is now to be played, the suppression or graying of display position 12*a*-12*e* as depicted in FIG. 11 is removed in FIG. 12 indicating that Hand 2 is now in play and, instead, display positions 11*a*-11*e* are suppressed or grayed indicating that Hand 1 is no longer in game play.

Game play now progresses to play Hand 2 and this is now described with reference to FIGS. 12 and 13. The player must initially analyze Hand 2 to determine what cards they want to hold and what cards they want to discard and replace. In this example the player chooses to hold the eight of clubs in position 12*a*, the nine of diamonds in position 12*c*, the five of clubs in position 12*d* and the seven of spades in position 12*e* in the hope of achieving a straight. The player touches these positions on display 10 in FIG. 12 and the word "HOLD" is displayed under the positions as shown. The player then touches DRAW button 18 to discard and redraw cards and the final draw poker hand is shown in FIG. 13. Under different circumstances the player may have alternatively decided to hold all cards and touched STAND button 17. In that instance no cards are discarded and replaced and game play would progress to the next step shown in FIG. 13.

In FIG. 13 it is seen that a six of spades is drawn into position 12*b*. The game program analyzes the final five cards in Hand 2 of FIG. 13 to determine if there is a winning hand. It can be seen in FIG. 13 that a straight has been achieved. Per the pay table in FIG. 3 a straight with a bet of two wins eight credits. This winning is displayed in the lower right corner of display 10 as "Pay Table Hand 2-8".

The game program then determines if there are any match winnings for Hand 2 in the fourth round of game play using the additional five cards dealt into Match Hand 19 (positions 19*a*-19*e*). The match process consists of comparing cards of Hand 1 in positions 11*a*-11*e* with corresponding cards in positions 19*a*-19*e* as previously described.

For Hand 2 in the fourth round of game play there are five suit matches for five credits. There is: (a) an eight of clubs in position 12*a* and a six of clubs in position 19*a*, (b) a six of spades in position 12*b* and a seven of spades in position 19*b*, (c) a nine of diamonds in position 12*c* and a jack of diamonds in position 19*c*, (d) a five of clubs in position 12*d* and a three of clubs in position 19*d*, and (e) a seven of hearts in both of positions 12*e* and 19*e*. There is one face value match. In position 12*e* there is a seven and in position 19*e* there is a seven for two credits. There is also one match of both face value and suit in positions 12*e* and 19*e* for three more credits. Accordingly, the numbers displayed in the Match Value window displayed in positions 11*a*-11*d* reads "100", and the numbers displayed in the Match Value window displayed in positions 11*e* reads "123". The total match value winnings for Hand 2 is displayed in the lower right corner of display 10 as "Match Total Hand 2-10". The third round of game play is now over as indicated by the words "Game Over" displayed at the bottom of display 10. The total game winnings are displayed in the lower right corner of display 10 as "Winnings 31".

Flow Chart

Figure 14:
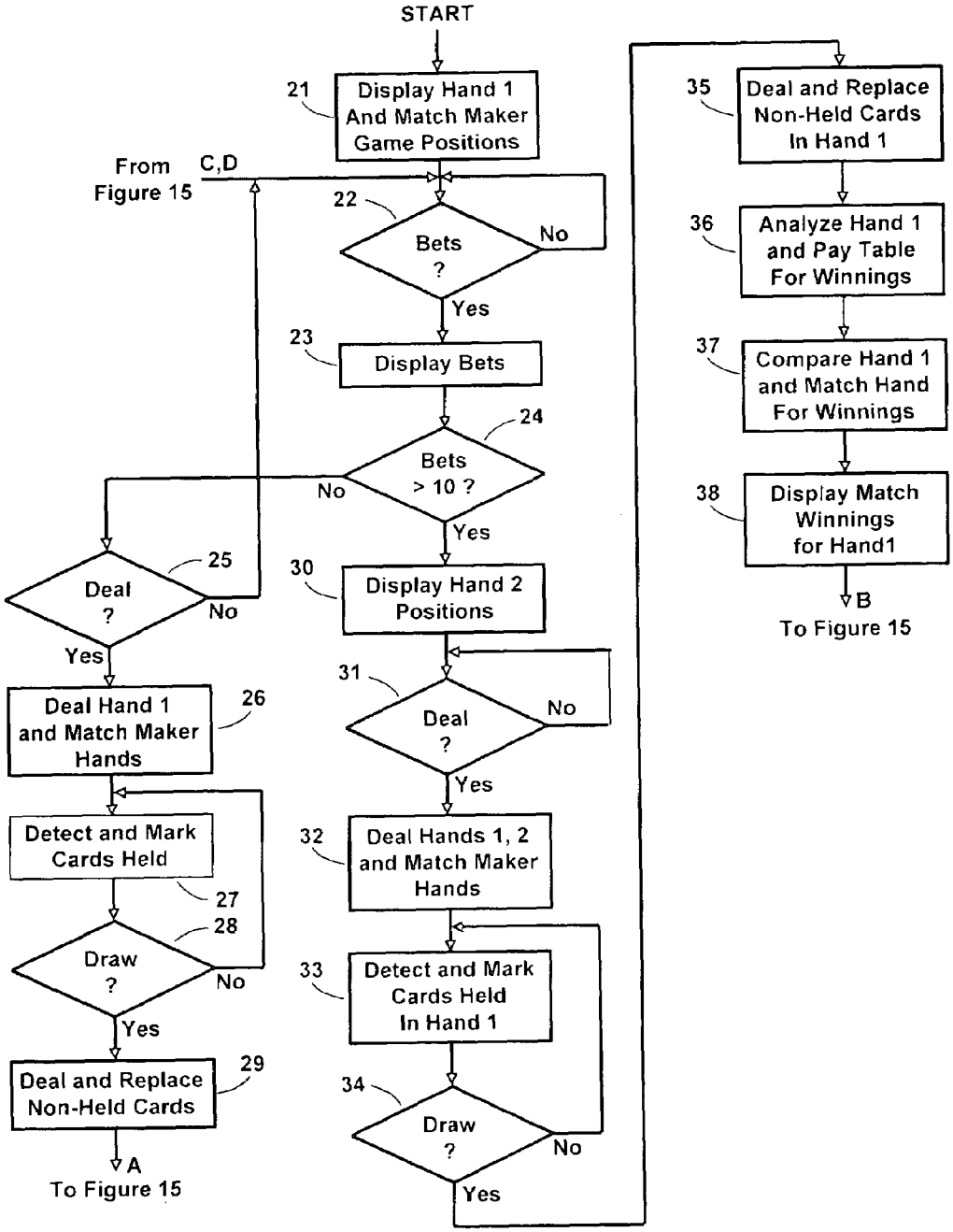
FIG. 14 is a first portion of a block diagram flow chart showing the steps of game play for the novel Match Poker game.
Figure 15:
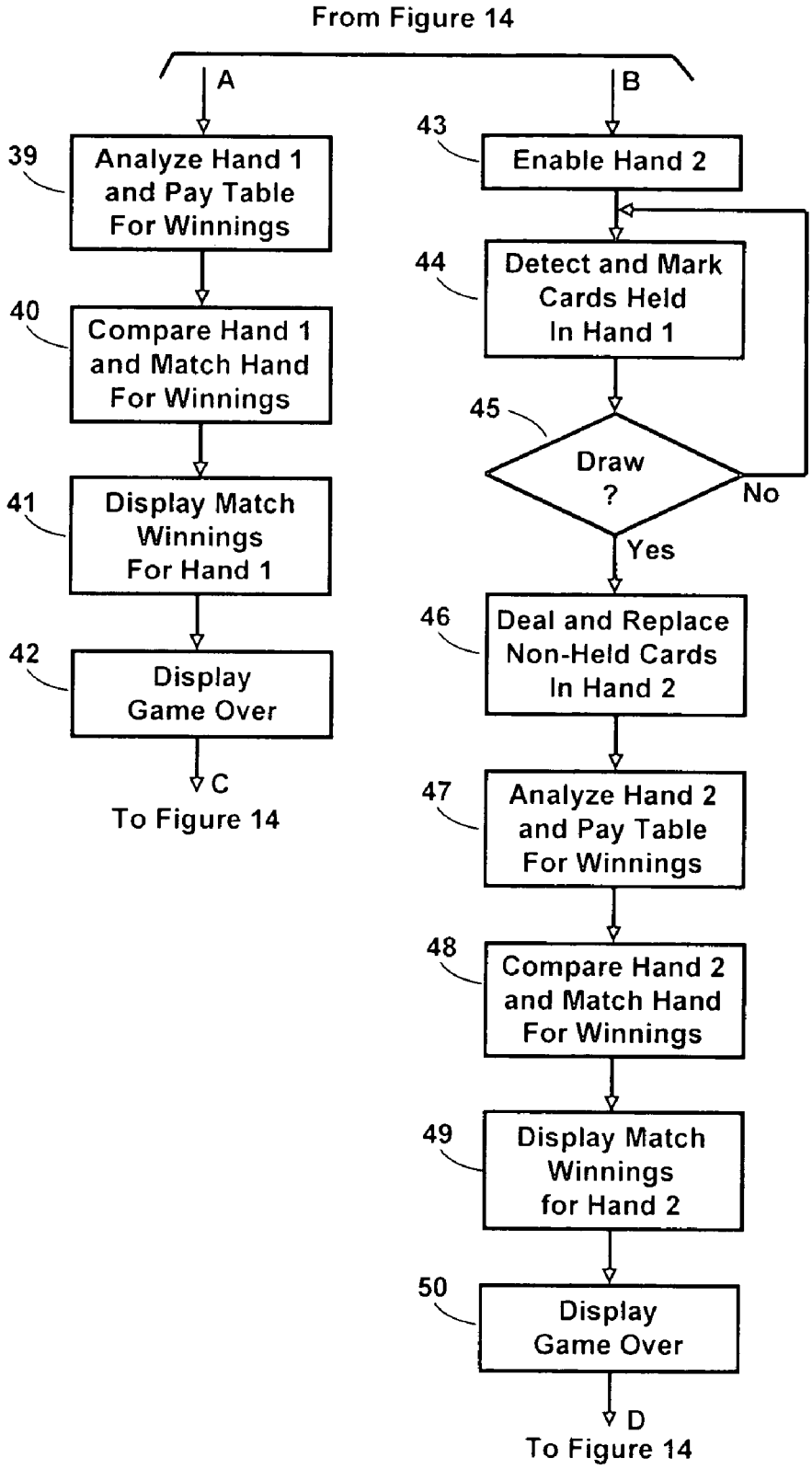
FIG. 15 is a final portion of a block diagram flow chart showing the steps of game play for the novel Match Poker game.

In FIGS. 14 and 15 is shown a block diagram flow chart showing the steps of game play for the novel Match Poker game. FIG. 14 shows a first portion of the flow chart and FIG. 15 shows the remainder of the flow chart for the novel Match Poker game. The two figures are joined by leads designated A, B, C and D. In FIG. 14 the game commences at START at the top of the figure. The first step in the game is at block 21 where the display shown in FIG. 1 is displayed. That is, Hand 1 (positions 11*a*-11*e*), the Match Hand (positions 19*a*-19*e*), buttons 13-16 and game play information is displayed in display locations 57-59.

At decision block 22 the game program awaits a player to place one or more bets to play a game of Match Poker. As long as no best are placed the program exits decision block 22 at No and cycles back to the input of block 22 to await bets to be placed by the player. When a bet is placed by the player the game exits block 22 at Yes and progresses to block 23 where the bet(s) made by the player is/are read and displayed. Initially, this will be one bet or the maximum number of bets. A second or subsequent bets are also sensed and displayed as described hereinafter. The program then progresses to decision block 24 where it is determined how many bets have been made by the player. As long as ten or fewer bets are made by the player the program exits decision block 24 at No and progresses to decision block 25 where the program watches for the player to touch DEAL button 16. As long as DEAL button 16 is not touched the program exits decision block 25 at No and cycles back to the input of decision block 22 to continue waiting for additional bets to be placed followed by DEAL button 16 to be touched. When a player has placed all their bets, and the total is less than ten, and then touches DEAL button 16 the program exits block 25 at Yes and progresses to block 26 where the program causes five cards to be dealt into display position 11*a*-11*e* of Hand 1 and five cards to be dealt into Match hand display positions 19*a*-19*e* as shown in FIGS. 4 and 6.

At block 27 the program watches for the player to touch ones of display positions 11*a*-11*e* in Hand 1 indicating cards that are to be held and the remainder of the cards to be discarded and redrawn. The game program progresses to decision block 28 where the program watches for on-screen DRAW button 18 to be touched indicating that the player has finished holding cards and non-held cards are to be replaced. As long as DRAW button 18 is not touched the program exits block 28 at No and cycles back to the input of block 27 to watch for any other cards to be held as indicated by the player touching the card display positions.

When DRAW button 18 is touched by the player the program exits decision block 28 at Yes and progresses to block 29 where all non-held cards are replaced with new cards. At the exit of block 29 there is a path marked by the letter "A" that goes to a path marked by the same letter "A" in FIG. 15. Now that all final cards have been dealt into Hand 1 the program progresses to block 39 in FIG. 15 where the final cards in Hand 1 are analyzed for a winning hand, to determine any winnings from the pay table shown in FIG. 3 according to the numbers of best made by the player, and to display the winnings. The winnings are displayed at the lower right corner of display 10 in FIGS. 5 and 7. In FIG. 5 the winnings are displayed as "Pay Table—3".

The next step in the game program is at block 40 where the face values and suits of the cards in display positions (11*a*-11*e*) of Hand 1 are compared to the face value and suit of the match cards dealt into the display positions 19*a*-19*e* of Match Hand 19 at the beginning of the game. At block 41 any such Match winnings are displayed such as shown at the lower right corner of display 10 in FIGS. 5 and 7. In FIG. 5 the display is "Match Total—1". At this point game play is over and at block 42 the program causes the words "Game Over" to be displayed to the right of DEAL button 16 in FIGS. 5 and 7. The program then cycles back via lead C to FIG. 14 to the input of decision block 22 to await a player touching ones of buttons 13-15 to change the bets placed. It is assumed by the program that if none of these buttons is touched that the number of bets remains the same as in the prior round of game play.

The above paragraph completes the description of the steps performed for a round of game play in which ten or less bets are made and only a single hand of cards (Hand 1) are dealt and played. The program steps are different if more than ten bets have been placed on a round of game play. In FIG. 14, at decision block 24, the program determines if more than ten bets have been made by the player on a round of game play. If the decision is No the program exits the block at No as previously described and a single hand of cards is played. If the decision is Yes, the program exits block 24 at Yes and progresses to block 30 where Hand 2 card display positions 12*a*-12*e* are placed on display 10 as shown in FIG. 2. In the even that a player has placed more than ten bets in a previous round of game play and both Hands 1 and 2 are displayed, and the player decreases their bets below ten, Hand 2 is removed from display 10. Even if a player has increased their bets above ten and Hand 2 is then added to the display and the player changes their mind and reduces their bets below ten, the display positions 12*a*-12*e* for Hand 2 are removed from display 10.

After the display positions 12*a*-12*e* for Hand 2 are displayed when more than ten bets have been placed, the program progresses to decision block 31 to watch for the player to touch DEAL button 16. As long as the player doesn't touch DEAL button 31 the program exits block 31 at No and cycles back to the input of block 31 to continue waiting for the player to touch DEAL button 16. The player may change the bets that they have made. When the player touches DEAL button 31 they are through placing bets and the program exits block 31 at Yes and progresses to block 32. At block 32 the program deals new hands of cards into Hand 1, Hand 2 and Match Hand 19. Hands 1 and 2 are played sequentially so the display of Hand 2 is initially suppressed or grayed somewhat as depicted in FIG. 8 to indicate to the player that Hand 2 is presently not in play.

The program then progresses to block 33 where the program watches for the player to touch ones of display positions 11*a*-11*e* in Hand 1 indicating cards that are to be held and the remainder of the cards in Hand I are to be discarded and redrawn. The game program progresses to decision block 34 where the program watches for DRAW button 18 to be touched indicating that the player has finished holding cards and non-held cards in Hand 1 are to be replaced. As long as DRAW button 18 is not touched the program exits decision block 34 at No and cycles back to the input of block 33 to watch for any other cards to be held as indicated by the player touching the card display positions.

When DRAW button 18 is touched by the player the program exits decision block 34 at Yes and progresses to block 35 where all non-held cards in Hand 1 are replaced with new cards. Now that all final cards are in Hand 1 the program progresses to block 36 where the final cards in Hand 1 are analyzed for a winning hand, to determine the winnings from the pay table shown in FIG. 3 according to the numbers of best made by the player, and to display the winnings. The winnings are displayed at the lower right corner of display 10 in FIGS. 10 and 13. In FIG. 10 the winnings are displayed as "Pay Table Hand 1-0".

The next step in the game program is at block 37 where the face value and suit of the cards in display positions 11*a*-11*e* of Hand 1 are compared to the face value and suit of the cards dealt into the display positions 19*a*-19*e* of Match Hand 19. At block 38 any such Match winnings are displayed such as shown at the lower right corner of display 10 in FIGS. 10 and 13. In FIG. 10 the display is "Match Total Hand 1-3". At this point game play for Hand 1 is over and the game program progresses to block 43 in FIG. 15 via lead B to play the cards of Hand 2.

At block 43 Hand 2 is enabled. Since game play is completed for Hand 1, and Hand 2 is now to be played, the suppression or graying of display position 12*a*-12*e* as depicted in FIG. 9 is removed indicating that Hand 2 is now in play and, instead, display positions 11*a*-11*e* are suppressed or grayed indicating that Hand 1 is no longer in game play.

At block 44 the game program watches for the player to touch ones of display positions 12*a*-12*e* in Hand 2 indicating ones of the cards that are to be held and the remainder of the cards are to be discarded and redrawn. The game program progresses to decision block 45 where the program watches for on-screen DRAW button 18 to be touched indicating that the player has finished holding cards and non-held cards are to be replaced. As long as DRAW button 18 is not touched the program exits block 45 at No and cycles back to the input of block 44 to watch for any other cards to be held as indicated by the player touching the card display positions.

When DRAW button 18 is touched by the player the program exits decision block 45 at Yes and progresses to block 46 where all non-held cards in Hand 2 are replaced with new cards. Now that all final cards are in Hand 2 the program progresses to block 47 where the final cards in Hand 2 are analyzed for a winning hand, to determine any winnings from the pay table shown in FIG. 3 according to the numbers of best made by the player, and to display the winnings. The winnings are displayed at the lower right corner of display 10 in FIGS. 10 and 13. In FIG. 10 the winnings are displayed as "Pay Table Hand 2-3".

The next step in the game program is at block 48 where the face value and suit of the cards in the display positions (12*a*-12*e*) of Hand 2 are compared to the face value and suit of the match cards dealt into the display positions 19*a*-19*e* of Match Hand. At block 49 any such match winnings for Hand 2 are displayed such as shown at the lower right corner of display 10 in FIGS. 10 and 13. In FIG. 10 the display is "Match Total Hand 2-1". At this point game play is over and at block 50 the program causes the words "Game Over" to be displayed to the right of DEAL button 16 such as shown in FIGS. 10 and 13. The program then cycles back via lead D to FIG. 14 to the input of decision block 22 to await a player touching ones of buttons 13-15 to change the bets placed. It is assumed that if none of these buttons is touched that the number of bets remains the same as in the prior round of game play.

The above paragraph completes the description of the program steps performed for a round of game play in which more than ten bets are made and two hands of cards (Hand 1 and Hand 2) are dealt and played.

Block Diagram

In FIG. 16 is shown a general block diagram of the electronic hardware used to implement a computer controlled implementation of the novel Match Poker game incorporating the teaching of the present invention. The heart of the computer controlled slot machine is a central processor unit (CPU) 52 running the Match Poker program that is stored in memory 53. The basic operations of a conventional draw poker game are well known in the art and are not repeated here for the sake of brevity. Responsive to the Match Poker game program CPU 52 causes a display on display 51, such as shown in FIGS. 1, 2 and 5-13. Coupled with display 51 is touch screen apparatus 55 that is well known in the art and indicates to CPU 52 when and where a player has touched ones of the on-screen buttons displayed on display 51 as previously described with reference to FIGS. 4-13.

The Match Poker game may have a slot for inserting coins or tokens for placing a number of wagers or bets for each round of game play. Alternatively, there may be a slot for the insertion of a debit card from which CPU 52 debits the number of credits or bets placed by a player, and to which CPU 52 credits any winnings. These monetary functions are shown at the box entitled Money/Card Sensor 54 which is connected to CPU 52 to receive indications of coin or token insertions, and to read and write a debit card under control of CPU 52. Also, when there is a slot for insertion of coins or tokens there will be a tray into which winnings in the form of coins or tokens are dispensed. This tray is shown as Payoff Device 56 which is controlled by CPU 52 to dispense winnings in the form of coins or tokens.

Using touch screen 55 CPU 52 monitors a player touching on-screen buttons described with reference to FIGS. 4-13 and responds accordingly to implement game functions as previously described.

In the third and fourth rounds of game play described hereinabove one deck of cards is used to deal hands 11*a*-11*e*, 12*a*-12*e* and 19*a*-19*e*. However, different decks of cards can be used to deal each hand of cards. In addition, while a maximum of two hands 11*a*-11*e* and 12*a*-12*e* may be played, depending on the number of hands chosen to be played by the player, the player may be permitted to play more than two hands of cards and have them each compared to the match hand 19*a*-19*e* for additional winnings.

In the four rounds of game play described hereinabove the player is dealt a match hand 19*a*-19*e* for every round of game play, and they get the match hand for no additional wagered credits. In a variant of the novel match poker game a player may have to wager a separate bet in order to get a match hand 19*a*-19*e*, and for additional bets the player may get additional match hands to compare against final hands of cards.

Figure 17:
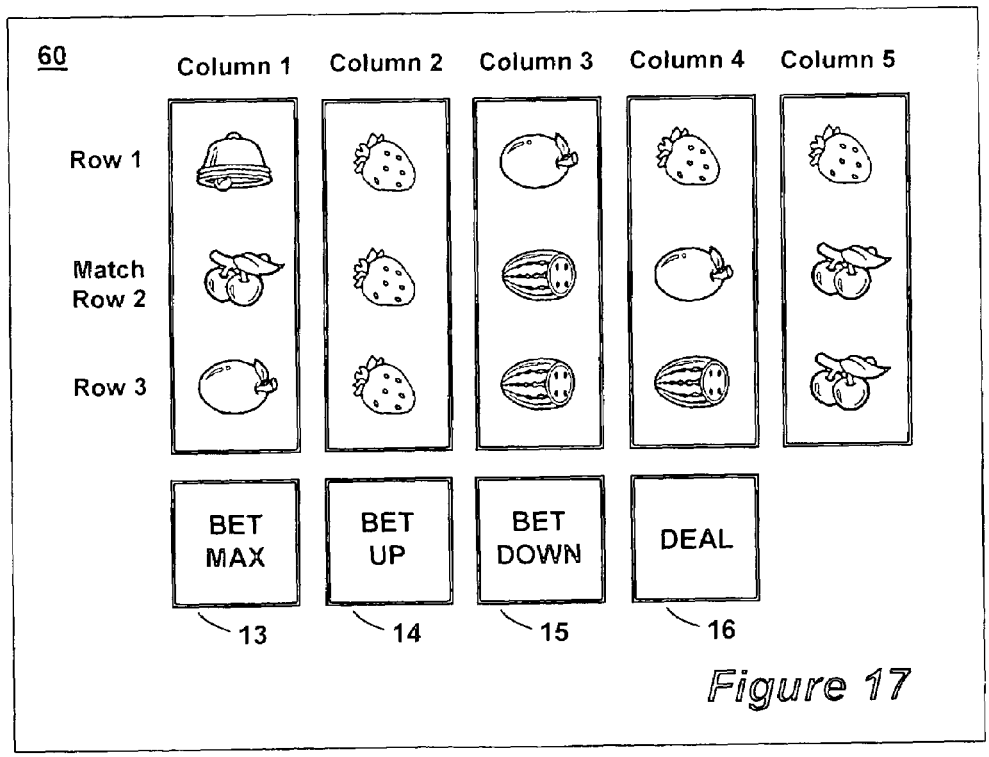
FIG. 17 shows the screen of a slot machine game implementing the match concept of the present invention.

In other variants of the novel match poker game a player may receive a match hand for free, but dependent on a triggering event such as having a full house hand of cards. The triggering event may be the player paying a fee to obtain a match hand. In addition, the number of match hands may vary dependent on different triggering events. For example, depending upon one or more triggering hand of cards being present the player may receive a match hand for the particular round of game play, or may receive a plurality of match hands to be use In FIG. 17 is shown a display screen 60 of a computer controlled video game implementing the novel match concept in a slot machine in accordance with the teaching of the present invention. Some standard features of a slot machine that are well known in the art are deliberately not shown in FIG. 17 to avoid detracting from the teaching of the present invention and to avoid cluttering the drawing.

In a conventional video slot gaming device a 3×5 matrix (3 rows by 5 columns) called a "five reel slot" is utilized. These are represented in FIG. 17 as Rows 1-3 and Columns 1-5. Rows 1 and 3 of the three rows are used to display five slot symbols in a conventional manner, depending on the number of bets placed. A player may select to play only Row 1 or both Rows 1 and 3. Row 2 is the match row and is used to implement the match concept. A player utilizes Bet Max button13, Bet Up button 14 and Bet Down button 15 to place a number of bets in a manner known in the art. Following the place of bets the player touches Deal button 16 to commence a round of game play. In a manner known in the art slot symbols are displayed in all fifteen positions of the 3×5 matrix.

The slot symbols in Row 1 are analyzed for any winnings. As shown in Row 1 there are three strawberries and a pay table (not shown) is used to determine the winnings for three of a kind. The slot symbols in Row 3 are then analyzed for any winnings. As shown in Row 3 there are two of a kind, two watermelons, and a pay table (not shown) is used to determine any winnings for two of a kind.

Then the slot symbols displayed in Match Row 2 are compared to the slot symbols in Rows 1 and 3 to determine any additional winnings for the game. When comparing Rows 1 and 2 it can be seen that there is a slot symbol match in column 2. When comparing Rows 2 and 3 it can be seen that there are slot symbol matches in columns 2, 3 and 5. These slot symbol matches yield extra winnings to the player. The amount of the winnings may vary but in the example described herein each slot symbol match yields one credit to the player. In addition to the winnings by having three strawberries in Row 1 the player also gains one extra credit by having strawberries in Column 2 of both Rows 1 and 2. In addition to any winnings, if any, by having two watermelons in Row 3 the player gains three extra credits by having slot symbol matches in Columns 2, 3 and 5 of both Rows 2 and 3.

While what has been described hereinabove are several examples of Match Poker game play per the preferred embodiment of the invention, and a number of alternatives, it should be understood that numerous changes maybe made without departing from the spirit and scope of the invention. Following are some examples of changes. At the conclusion of each round of game play, played hand cards that have face value and suit value matches with the match hand will be grayed or otherwise highlighted. In another variant as the hands of cards are dealt they may be dealt sequentially or concurrently. In yet another variant a player will initially indicate the number of bets they wish to play and they will commence automatic game play of a plurality of rounds of game play. Cards to be held are automatically determined for each round of game play and rounds of game play are automatically, sequentially played until the player stops game play. In still another variant the results of face value and suit matches with the match hand of cards are displayed one card at a time rather than concurrently. Different ones of these variants may also be combined.

What is claimed is:

1. A method of playing a modified draw poker game using a deck of cards wherein a player has a chance to hold cards and to reject and replace other cards during the course of game play, the method comprising the steps of:

(a) dealing an initial hand of cards to a player, the initial hand of cards being initially dealt face up to the player;

(b) dealing an second hand of cards to a the player at the same time the initial hand of cards are dealt to the player, the second hand of cards being initially dealt face up to the player;

(c) drawing replacement cards for cards rejected by the player from the initial hand of cards to achieve a final hand of cards;

(d) determining if the player's final hand of cards is a winning hand of cards and awarding winnings to the player for a winning hand of cards;

(e) comparing the second hand of cards to the final hand of cards to determine matches in predetermined characteristics between the cards in the second hand of cards and the final hand of cards; and (f) awarding winnings to the player for each match in the predetermined characteristics between the second hand of cards and the final hand of cards.

2. The method of playing a modified draw poker game in accordance with claim 1 wherein step (e) comprises the steps of comparing the face value and/or suit of the cards in the second hand of cards to the final hand of cards and awarding the winnings in step (f) based upon matches in the face value and the suit of the cards.

3. The method of playing a modified draw poker game in accordance with claim 2 further comprising the steps of:

(g) selecting a plurality of hands of cards to be played prior to performing step (a);

(h) performing steps (a) through (f) for a first of the plurality of hands of cards selected to be played in step (g); and (i) sequentially repeating steps (a) through (f) for a second and all other of the plurality of initial hands of cards selected to be played in step (g).

4. The method of playing a modified draw poker game in accordance with claim 1 further comprising the step:

(g) selecting a plurality of hands of cards to be played prior to performing step (a);

(h) performing steps (a) through (f) for a first of the plurality of hands of cards selected to be played in step (g); and (h) sequentially repeating steps (a) through (f) for a second and all other of the plurality of initial hands of cards selected to be played in step (g).

5. A method of playing a modified draw poker game using a deck of cards wherein a player has a chance to hold cards and to reject and replace other cards during the course of game play, the method comprising the steps of:

(a) a player selecting a plurality of hands of cards to be played;

(b) dealing an initial hand of cards for each of the plurality of hands of cards selected to be played in step (a), each initial hand of cards being initially dealt face up to the player;

(c) dealing a match hand of cards to the player at the same time the plurality of initial hands of cards are dealt to the player in step (b), the match hand of cards being initially dealt face up to the player;

(d) sequentially drawing replacement cards for cards rejected by the player from each of the plurality of initial hands of cards dealt in step (b) to achieve final hands of cards;

(e) determining if each of the player's plurality of final hands of cards in step (d) is a winning hand of cards and awarding winnings to the player for each winning final hand of cards;

(f) comparing the match hand of cards dealt in step (c) to each of the final hands of cards of step (d) to determine matches in predetermined characteristics between the cards; and (g) awarding winnings to the player for each match of predetermined characteristics determined in step (f).

6. The method of playing a modified draw poker game in accordance with claim 5 wherein the predetermined characteristics of the cards are the face value and/or suit of the cards and step (f) comprises comparing the face value and suit of the cards in the match hand of cards to the final hand of cards and awarding the winnings of step (g) based upon matches in the face value and suit of the cards.

7. The method of playing a modified draw poker game in accordance with claim 6 wherein the dealing of a match hand of cards to a player in step (b) is dependent upon the occurrence of a triggering event.

8. The method of playing a modified draw poker game in accordance with claim 5 wherein the dealing a match hand of cards to a player in step (b) is dependent upon the occurrence of a triggering event.

* * * * *